US009259138B2

(12) United States Patent
Chen et al.

(10) Patent No.: US 9,259,138 B2
(45) Date of Patent: Feb. 16, 2016

(54) DISHWASHER WITH AUXILIARY SPRAY SYSTEM HAVING REMOVABLE SPRAYERS

(75) Inventors: David H. Chen, St. Joseph, MI (US); Kristopher L. Delgado, Stevensville, MI (US); Jordan R. Fountain, St. Joseph, MI (US); Antony M. Rappette, Benton Harbor, MI (US); Eric J. Schuh, Stevensville, MI (US); Barry E. Tuller, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1471 days.

(21) Appl. No.: 12/961,538

(22) Filed: Dec. 7, 2010

(65) Prior Publication Data

US 2012/0138110 A1 Jun. 7, 2012

(51) Int. Cl.

| | |
|---|---|
| ***A47L 15/42*** | (2006.01) |
| ***A47L 15/00*** | (2006.01) |
| ***A47L 15/22*** | (2006.01) |
| ***A47L 15/50*** | (2006.01) |

(52) U.S. Cl.

CPC ..... *A47L 15/4278* (2013.01); *A47L 15/0018* (2013.01); *A47L 15/22* (2013.01); *A47L 15/505* (2013.01); *A47L 2401/06* (2013.01); *A47L 2401/08* (2013.01); *A47L 2401/24* (2013.01); *A47L 2501/01* (2013.01); *A47L 2501/03* (2013.01)

(58) Field of Classification Search

CPC . A47L 15/0018; A47L 15/22; A47L 15/4278; A47L 15/505; A47L 2501/03; A47L 2401/08; A47L 2401/24; A47L 2501/01; A47L 2401/06

See application file for complete search history.

(56) References Cited

U.S. PATENT DOCUMENTS

| | | | |
|---|---|---|---|
| 1,598,352 | A | 8/1926 | Kehoe et al. |
| 1,897,821 | A | 2/1933 | Poli |
| 2,407,533 | A | 9/1946 | Brock |
| 2,918,927 | A | 12/1959 | Clearman |
| 3,060,944 | A | 10/1962 | Brollo |
| 3,095,885 | A | 7/1963 | Hertell |
| 3,217,721 | A | 11/1965 | Hertel |
| 3,253,784 | A | 5/1966 | Long et al. |
| 3,468,486 | A | 9/1969 | Mercer |
| 3,586,011 | A | 6/1971 | Mazza |
| 3,648,931 | A | 3/1972 | Jacobs |
| 3,718,149 | A | 2/1973 | Mazza |
| 3,828,818 | A | 8/1974 | Hunt |
| 3,915,180 | A | 10/1975 | Jacobs |

(Continued)

FOREIGN PATENT DOCUMENTS

| | | | |
|---|---|---|---|
| AU | 2008247466 | A1 | 11/2008 |
| BR | PI0505649 | A | 9/2006 |

(Continued)

OTHER PUBLICATIONS

Bosch User Manual for Dishwasher, p. 22, Downloaded From boschappliances.com on Feb. 15, 2005.

(Continued)

*Primary Examiner* — Michael Barr
*Assistant Examiner* — Benjamin L Osterhout

(57) ABSTRACT

An automatic dishwasher having at least one primary sprayer and at least one auxiliary sprayer located within a treating chamber. Wherein the at least one auxiliary sprayer is removably mounted in the treating chamber.

37 Claims, 5 Drawing Sheets

(56) References Cited

U.S. PATENT DOCUMENTS

| | | | | |
|---|---|---|---|---|
| 4,094,702 | A | 6/1978 | Rabuffetti | |
| 4,279,384 | A | 7/1981 | Yamamoto | |
| 4,320,781 | A | 3/1982 | Bouvet et al. | |
| 5,131,419 | A | 7/1992 | Roberts | |
| 5,264,043 | A | 11/1993 | Milocco | |
| 5,331,986 | A | 7/1994 | Lim et al. | |
| 5,494,062 | A | 2/1996 | Springer | |
| 5,497,798 | A | 3/1996 | Fritz et al. | |
| 5,542,443 | A | 8/1996 | Yura et al. | |
| 5,823,211 | A | 10/1998 | Wilhelmstatter et al. | |
| 5,849,101 | A | 12/1998 | Edwards et al. | |
| 6,003,529 | A | 12/1999 | Perry, Jr. | |
| 6,431,188 | B1 | 8/2002 | Laszczewski, Jr. et al. | |
| 6,432,216 | B1 * | 8/2002 | Thies | 134/18 |
| 6,491,049 | B1 * | 12/2002 | Tuller et al. | 134/200 |
| 6,612,009 | B1 | 9/2003 | Laszczewski, Jr. et al. | |
| 6,666,220 | B2 | 12/2003 | Spanyer et al. | |
| 6,869,029 | B2 | 3/2005 | Ochoa, Sr. et al. | |
| 7,055,537 | B2 | 6/2006 | Elick et al. | |
| 7,331,356 | B2 | 2/2008 | VanderRoest et al. | |
| 7,445,013 | B2 | 11/2008 | VanderRoest et al. | |
| 7,475,696 | B2 | 1/2009 | Vanderroest et al. | |
| 7,523,758 | B2 | 4/2009 | Vanderroest et al. | |
| 7,594,513 | B2 | 9/2009 | VanderRoest et al. | |
| 7,947,132 | B2 | 5/2011 | Vanderroest et al. | |
| 8,137,479 | B2 | 3/2012 | Vanderroest et al. | |
| 8,187,390 | B2 | 5/2012 | Vanderroest et al. | |
| 8,454,762 | B2 | 6/2013 | Vanderroest et al. | |
| 2003/0168087 | A1 | 9/2003 | Inui et al. | |
| 2004/0173249 | A1 | 9/2004 | Assmann et al. | |
| 2005/0022847 | A1 | 2/2005 | Nito et al. | |
| 2005/0224098 | A1 | 10/2005 | Fujii et al. | |
| 2006/0054198 | A1 | 3/2006 | Choi | |
| 2007/0056613 | A1 | 3/2007 | Haas et al. | |
| 2007/0119485 | A1 * | 5/2007 | Gunnerson et al. | 134/58 DL |
| 2008/0163904 | A1 | 7/2008 | Hwang | |
| 2008/0271765 | A1 | 11/2008 | Burrows | |
| 2009/0090400 | A1 | 4/2009 | Burrows et al. | |
| 2009/0159103 | A1 * | 6/2009 | Gillum et al. | 134/98.1 |
| 2011/0030742 | A1 | 2/2011 | Dalsing et al. | |
| 2012/0125381 | A1 | 5/2012 | Vanderroest et al. | |
| 2012/0125382 | A1 | 5/2012 | Vanderroest et al. | |
| 2013/0092194 | A1 | 4/2013 | Carlson et al. | |

FOREIGN PATENT DOCUMENTS

| | | | |
|---|---|---|---|
| BR | PI0506303 | A | 7/2007 |
| CA | 2527846 | A1 | 6/2006 |
| CA | 2527848 | A1 | 6/2006 |
| CN | 1182570 | A | 5/1998 |
| DE | 7417444 | | 5/1974 |
| DE | 2911005 | A1 | 9/1980 |
| DE | 3403359 | A1 | 8/1985 |
| DE | 19544985 | A1 | 6/1996 |
| DE | 19611054 | A1 | 9/1997 |
| DE | 10124645 | A1 | 12/2001 |
| EP | 0291713 | A1 | 11/1988 |
| EP | 0517015 | A1 | 12/1992 |
| EP | 0755650 | A1 | 1/1997 |
| EP | 0786230 | A2 | 7/1997 |
| EP | 795292 | A2 | 9/1997 |
| EP | 0796587 | A2 | 9/1997 |
| EP | 1040787 | A1 | 10/2000 |
| EP | 1252856 | A2 | 10/2002 |
| EP | 1264570 | A1 | 12/2002 |
| EP | 1488730 | A1 | 12/2004 |
| EP | 1676520 | A2 | 7/2006 |
| EP | 1676521 | A2 | 7/2006 |
| EP | 2152138 | A1 | 2/2010 |
| EP | 2583611 | A2 | 4/2013 |
| ES | 2134657 | T3 | 10/1999 |
| ES | 2321711 | T3 | 6/2009 |
| ES | 2340859 | T3 | 6/2010 |
| GB | 668181 | A | 3/1952 |
| JP | 9285435 | A | 11/1997 |
| JP | 11076127 | A | 3/1999 |
| JP | 2001218721 | A | 8/2001 |
| JP | 2002065562 | A | 3/2002 |
| JP | 2002219088 | A | 8/2002 |
| JP | 2007105210 | A | 4/2007 |
| KR | 19950003025 | | 2/1995 |
| KR | 19970064554 | | 10/1997 |
| KR | 19980031929 | | 8/1998 |
| KR | 19990031442 | | 7/1999 |
| KR | 20040006218 | A | 1/2004 |
| KR | 200366704 | | 10/2004 |
| KR | 20050122359 | A | 12/2005 |
| KR | 20060013790 | A | 2/2006 |
| KR | 20060085973 | A | 7/2006 |
| KR | 20060087396 | A | 8/2006 |
| KR | 100745084 | A | 7/2007 |
| KR | 20070078129 | A | 7/2007 |
| KR | 100842370 | B1 | 6/2008 |
| KR | 20080083911 | A | 9/2008 |
| KR | 20090014510 | A | 2/2009 |
| MX | PA05013870 | A | 6/2006 |
| MX | PA05013873 | A | 6/2006 |
| TR | 9700217 | A2 | 10/1997 |
| WO | 0022973 | A1 | 4/2000 |
| WO | 2004058035 | A1 | 7/2004 |
| WO | 2008137818 | A1 | 11/2008 |
| WO | 2008137820 | A1 | 11/2008 |

OTHER PUBLICATIONS

The Perfect Ten, 2005 American Building Product Awards, Home Magazine, homemag.com, Published Feb. 2005.

Asko Unveils New Dishwasher, Appliance Magazine, Published May 8, 2003, Downloaded From appliancemagazine.com Sep. 26, 2005.

Dishwashers, Power at a Price, Consumer Reports, p. 34, Published Mar. 2005.

Bosch SHU43 Built-In Dishwasher, epinions.com, Published Jan. 26, 2001.

First Look, Power Washer, p. 91, Good Housekeeping Magazine, Published Sep. 2004.

Supplemental Examination as filed for U.S. Appl. No. 96/000,044, Oct. 25, 2013.

USPTO Notice of Intent to Issue a Reexam Certificate for U.S. Appl. No. 96/000,044, Mar. 19, 2014.

* cited by examiner

DISHWASHER WITH AUXILIARY SPRAY SYSTEM HAVING REMOVABLE SPRAYERS

BACKGROUND OF THE INVENTION

Contemporary automatic dishwashers for use in a typical household include a tub and upper and lower utensil racks or baskets for supporting utensils within the tub. A recirculation system having multiple permanent sprayers, which are provided liquid by a pump, is provided for recirculating wash liquid throughout the tub to remove soils from the utensils. The dishwasher may have a controller that implements a number of pre-programmed cycles of operation to wash utensils contained in the tub.

SUMMARY OF THE INVENTION

The invention relates to an automatic dishwasher having a tub defining a treating chamber, a liquid recirculation system for recirculating liquid in the treating chamber, at least one permanent primary sprayer, and at least one removable auxiliary sprayer coupled to a portion of the recirculation system.

DESCRIPTION OF EMBODIMENTS OF THE INVENTION

The invention generally relates to a dishwasher having a primary spraying system having at least one permanent sprayer providing permanent spray zones within the dishwasher and an auxiliary spray system having at least one removable sprayer, which may be used to provide additional spray zones that may be selectively reconfigured by the user, and which supplement the permanent zones. The auxiliary spray system may have multiple fluid connections that provide for placing and/or repositioning one or more of the removable sprayers at a plurality of locations within the dishwasher, which provide the user with great flexibility in configuring the spray zones.

Figure 1:
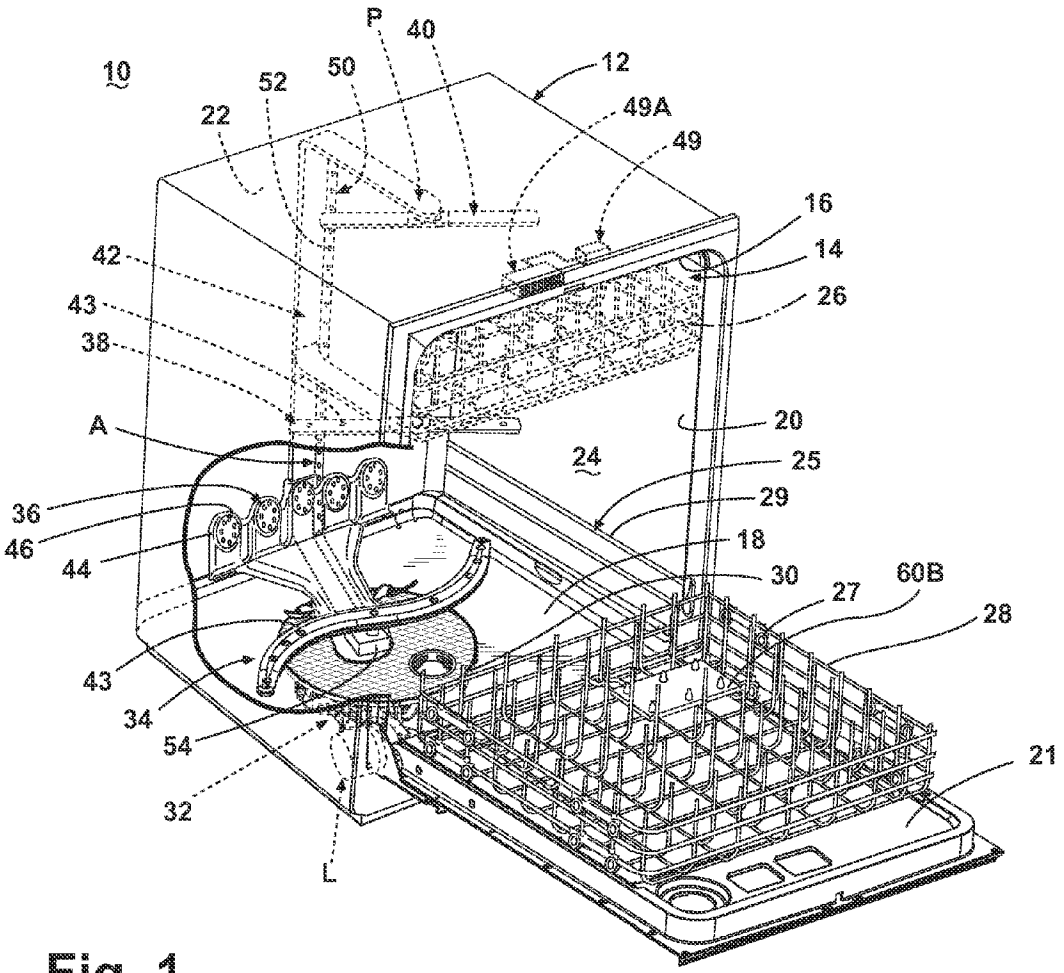
FIG. 1 is a perspective view of a dishwasher according to a first embodiment of the invention including a removable auxiliary sprayer.

Referring now to FIG. 1, a first embodiment of the invention is illustrated as an automatic dishwasher 10 having a housing 12, which may be in the form of a cabinet, chassis, frame, with or without decorative outer panels, or other known structures. The dishwasher 10 shares many features of a conventional automatic dishwasher, which will not be described in detail herein except as necessary for a complete understanding of the invention. The housing 12 encloses a wash tub 14, which at least partially defines a treating chamber 24 for receiving utensils for treatment, such as washing. The wash tub 14 may be thought of as having spaced top and bottom walls 16 and 18, spaced sidewalls 20, a front wall 21, and a rear wall 22. The front wall 21 may be the door of the dishwasher 10, which may be pivotally attached to the dishwasher 10 for providing accessibility to the treating chamber 24 for loading and unloading utensils or other washable items. In this manner, the door may be considered as forming part of the treating chamber 24. The bottom wall 18 of the dishwasher may be sloped to define a lower tub region or sump 30 of the wash tub 14.

Utensil holders in the form of upper and lower utensil racks 26, 28 are located within the treating chamber 24 and receive utensils for washing. The upper and lower utensil racks 26, 28 are typically mounted for slidable movement between a wash position, where the utensil racks 26, 28 reside within the treating chamber 24, and a load position, where at least a portion of the utensil racks 26, 28 reside outside the treating chamber 24. For example, a number of roller assemblies 25 are positioned between the utensil racks 26, 28 and the wash tub 14. The roller assemblies 25 allow the utensil racks 26, 28 to extend from and retract into the wash tub 14, which facilitates the loading and unloading of the utensil racks 26, 28. The roller assemblies 25 include a number of rollers 27 that move along a corresponding support rail 29.

As used in this description, the term "utensil(s)" is intended to be generic to any item, single or plural, that may be treated in the dishwasher 10, including, without limitation; dishes, plates, pots, bowls, pans, glassware, and silverware. Also, while the present invention is described in terms of a conventional dishwashing unit as illustrated in FIG. 1, it could also be implemented in other types of dishwashing units such as in-sink dishwashers or drawer dishwashers.

A primary spray system P and an auxiliary spray system A may be provided for spraying liquid within the treating chamber 24. The primary spray system P provides spray zones within the treating chamber 24 that are intended to be permanent and fixed by the manufacturer, while the auxiliary spray system A provides for user-selected and user-configurable spray zones in the treating chamber 24, which may implemented at the whim of the user.

Figure 2:
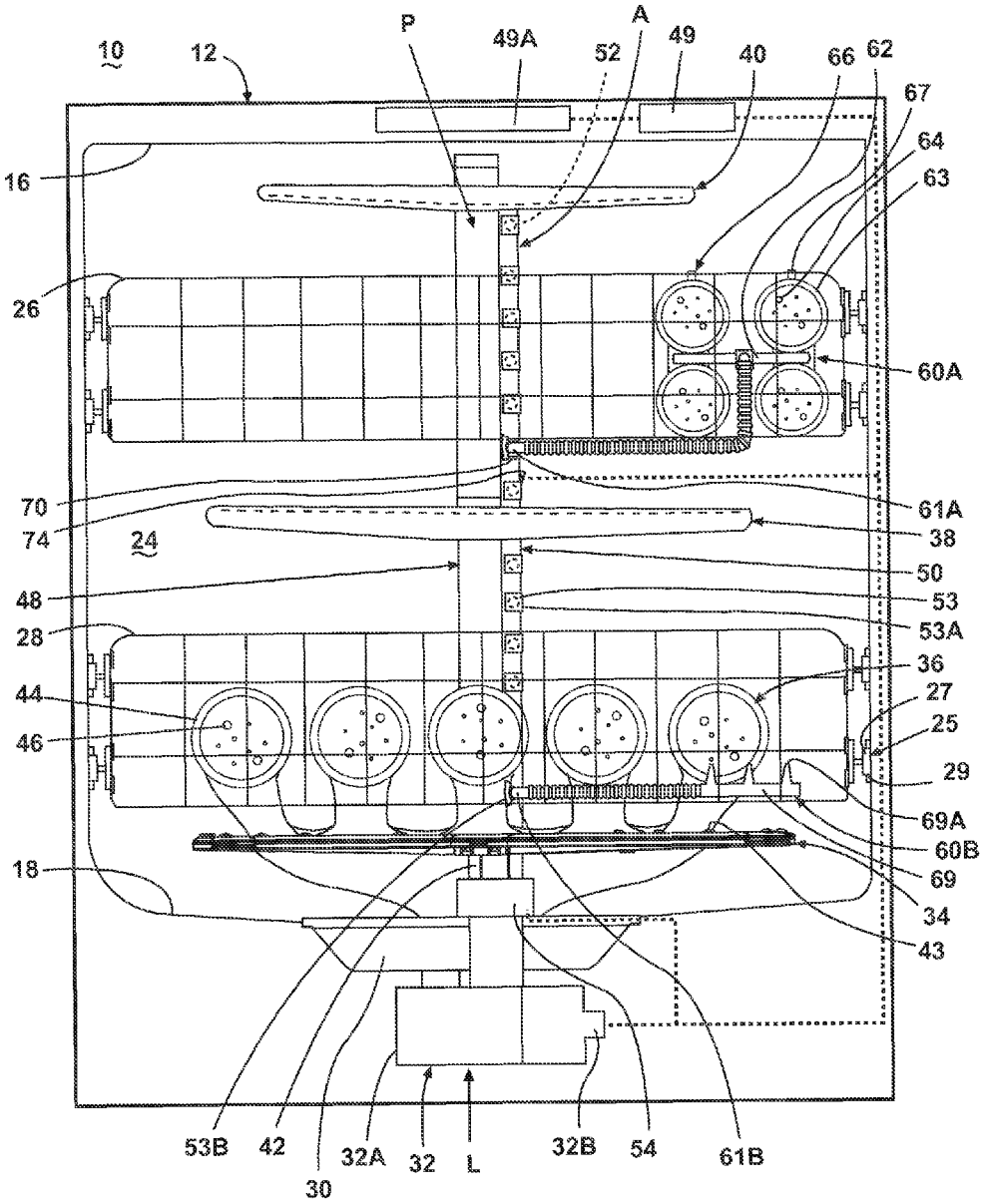
FIG. 2 is a schematic front view of the dishwasher shown in FIG. 1 including two examples of removable auxiliary sprayers and with the door removed for clarity.

A liquid supply system L recirculates liquid from the sump 30 to either the primary spray system P or the auxiliary spray system A. The liquid supply system L may selectively supply liquid between the primary spray system P and the auxiliary spray system A. As such, a pump assembly 32 and a diverter 54, which selectively couples the output of the pump assembly 32 to either the primary spray system P or auxiliary spray system A, are provided to draw liquid from the sump 30 and to pump the liquid to either the primary spray system P or the auxiliary spray system A. The pump assembly 32 may include a pump 32A (FIG. 2) driven by a motor 32B (FIG. 2). The motor 32B may run at multiple speeds and such variable speeds may allow the pump 32A to produce a variable pressure water supply. The liquid may be water, a wash aid, or any combination there of. Examples of common wash aids include: a detergent, a spot reducer, a rinse agent, a stain remover, bleach, or any other similar product that facilitates excellent cleaning of the utensils.

A controller 49 with a user interface 49A may be provided on the dishwasher 10. The controller 49 is operably coupled to and controls the operation of the liquid supply system to implement a treating cycle of operation, such as a washing cycle where liquid is sprayed on utensils in the treating chamber to remove soils, by controlling the supply of liquid to either the primary spray system P or the auxiliary spray system A. The user interface 49A may be provided on housing 12 or on the outer panel of the door and can include operational controls such as dials, lights, switches, and displays enabling a user to input commands to the controller 49 and receive information about the selected treating cycle. Alternately, the treating cycle may be automatically selected by the controller 49 based on soil levels sensed by the dishwasher 10 to optimize the cleaning performance of the dishwasher 10 for a particular load of utensils. The controller 49 may be preprogrammed with a number of different cleaning cycles from which a user may select one cleaning cycle to clean a load of utensils. Examples of cleaning cycles include normal, light/china, heavy/pots and pans, and rinse only.

The dishwasher 10 may further include other conventional components such as additional permanent nozzles, a drain pump, a filter, a heater, etc.; however, these components are not germane to the present invention and will not be described further herein.

Referring to FIG. 2, the details of the primary and auxiliary spray systems P, A will be described. The primary spray system P has multiple permanent sprayers 34, 36, 38, 40. A primary supply conduit 42 fluidly couples the diverter 54 to the multiple permanent sprayers 34, 36, 38, 40. As used in this description, the term "permanent sprayer" is intended to be a generic term for any manufacturer-installed sprayer that is not intended to be removed from the dishwasher 10 except for repair or maintenance. Four permanent sprayers 34-40 have been illustrated as being located in the dishwasher 10, with it being contemplated that more or fewer permanent sprayers may be housed in the dishwasher 10.

The permanent sprayer 34 is positioned beneath the lower utensil rack 28 and is illustrated as having an arm configured to rotate in the wash tub 14 and spray a flow of wash liquid from at least one outlet 43, in a primarily upward direction, over a portion of the interior of the wash tub 14 to define a first wash zone directed to wash utensils located in the lower utensil rack 28. The first lower permanent spray assembly 34 may optionally also provide a liquid spray downwardly onto the sump 30, but for purposes of simplification, this will not be illustrated or described herein.

The permanent sprayer 36 is illustrated as being located adjacent the lower utensil rack 28 toward the rear of the treating chamber 24 and has a horizontally oriented manifold 44 supplying liquid to multiple nozzles 46 to provide a spray zone in a generally lateral direction into a side of the lower utensil rack 28. Such a spray manifold is set forth in detail in U.S. Pat. No. 7,594,513, issued Sep. 29, 2009, and titled "Multiple Wash Zone Dishwasher," which is incorporated herein by reference in its entirety.

The permanent sprayer 38 is a rotating spray arm positioned between the upper utensil rack 26 and the lower utensil rack 28 and sprays a flow of wash liquid from at least one outlet 43, in a generally upward direction into the bottom of the upper utensil rack 26.

The permanent sprayer 40 is a rotating spray arm positioned above the upper utensil rack 26 and generally directs a spray of wash liquid in a generally downward direction and helps wash utensils on both upper and lower utensil racks 26, 28.

The auxiliary spray system A is illustrated as having multiple auxiliary sprayers 60A and 60B. An auxiliary supply conduit 50 fluidly couples the diverter 54 to the multiple auxiliary sprayers 60A and 60B.

Multiple fluid outlets 52 are provided along the length of the auxiliary supply conduit 50. Although multiple fluid outlets 52 are shown in the present embodiment, fewer or more fluid outlets could readily be provided. The multiple fluid outlets provide a variety of places at which the auxiliary sprayers 60A and 60B may be fluidly coupled based on user preference.

A valve such as a flapper valve 53 may be provided with each of the fluid outlets 52 to seal the fluid outlets 52 when an auxiliary sprayer is not coupled thereto. Each flapper valve 53 may be pivotally connected to the auxiliary supply conduit 50 so as to be pivotal between a closed position 53A where it engages the fluid outlet 52, and an open position 53B where it is spaced from the fluid outlet 52 so that an auxiliary sprayer may be inserted into the fluid outlet 52. Any suitable flapper valve may be used as such details of the flapper valves 53 are not germane to the invention and will not be described further herein. Further, it has been contemplated that alternative sealing mechanisms or valves may be used to fluidly seal each fluid outlet 52 when it is not in use.

Each of the auxiliary sprayers 60A, 60B have a fluid inlet 61A and 61B, respectively, which is configured to mate with the fluid outlets 52 to establish liquid supply from the auxiliary supply conduit 50 to the auxiliary sprayer 60A, 60B. The fluid inlets 61A and 61B may be a hose received within the fluid outlet 52, which, upon insertion into the fluid conduit 52, will open the flapper valve 53. Alternatively, as illustrated with the removable auxiliary sprayer 60A, a fluid coupling or fluid coupler 70 may be used for releasably coupling the fluid inlet 61A of the removable auxiliary sprayer 60A to one of the fluid outlets 52. Non-limiting examples of fluid couplers 70 include quick-connects or valve mechanism. In the case of a valve mechanism type fluid coupler 70, the fluid coupler 70 may include a valve associated with the fluid outlet 52, and a valve opener provided with the fluid inlet 61A. The valve opener would act to open the valve when the removable auxiliary sprayer 60A is fluidly coupled to the auxiliary supply conduit 50. Alternatively, the valve may be provided with the fluid inlet 61A while the valve opener may be provided with the fluid outlet 52.

The auxiliary sprayer 60A has a housing or manifold 62 fluidly coupled to the hose having the fluid inlet 61A. A plurality of spray heads or spray nozzles 63 having apertures 64 are fluidly coupled to the manifold 62, whereby liquid may pass from the auxiliary supply conduit 50, through the fluid inlet 61A, into the manifold 62, where it is emitted through the apertures 64 of the spray nozzles 63 to spray wash liquid into the upper utensil rack 26. A secondary or auxiliary wash zone may be defined by the spray field emitted by the removable auxiliary sprayer 60A into the treating chamber 24. The spray nozzles 63 may be fixed or rotatable with respect to the manifold 62. The wash liquid being sprayed from the apertures 64 may be under pressure and may thereby create an intensified spray.

The auxiliary sprayer 60A includes a rack mount 66, which may releasably mount the removable auxiliary sprayer 60A to the upper utensil rack 26. The rack mount 66 includes a pair of connectors 67, which are attached to the spray nozzles 63 of the removable auxiliary sprayer 60. The connectors 67 may be of any shape or configuration such that the removable auxiliary sprayer 60A may be removably mounted to the upper utensil rack 26. For example, as illustrated, the connectors 67 may include a downwardly open recess which forms a hook allowing the connectors 67 to hook over a portion of the upper utensil rack 26. Alternatively, the connectors 67 may form a snap such that the connectors 67 may snap onto a portion of the upper utensil rack 26. The illustrated location of the connectors 67 is by way of example only; it has been contemplated that the connectors 67 may alternatively be located on other portions of the removable auxiliary sprayer 60A such as on the manifold 62.

It is contemplated that the rack mount 66 may have alternative configurations and may be formed of various connectors, which securely but removably hold the removable auxiliary sprayer 60A to either of the utensil racks 26, 28. It is also contemplated that the manifold 62 or nozzles 63 of the removable auxiliary sprayer 60A may be shaped such that they may be removably mounted to one of the utensil racks 26, 28 without the need for a separate rack mount. Further, it has been contemplated that an alternative mount may be used to securely but removably hold the removable auxiliary sprayer 60A to the wash tub 14.

The auxiliary sprayer 60B is illustrated as being removably mounted in the treating chamber 24 and being located within and supported by the lower utensil rack 28. The removable auxiliary sprayer 60B is illustrated as including a housing or manifold 69, which is fluidly coupled to the fluid inlet 61B. The manifold 69 is also illustrated as having multiple spray nozzles 69A, which have a decreasing cross section to increase the velocity of the emitted spray. Specifically, the nozzles have a cone-like shape which creates an intensified spray. Another auxiliary wash zone may be defined by the spray field emitted by the removable auxiliary sprayer 60B into the treating chamber 24. Alternatively, the spray fields emitted by both removable auxiliary sprayers 60A, 60B may be considered to form an auxiliary wash zone.

While the auxiliary sprayer 60B is illustrated as resting on the bottom of the lower utensil rack 28, the auxiliary sprayer 60B may be provided with the same rack mounts as the auxiliary sprayer 60A to further secure and/or fix the position of the auxiliary sprayer 60B to the lower utensil rack 28.

With this configuration, the auxiliary sprayers 60A, 60B may be removably mounted within the treating chamber 24 at any location that is convenient for and/or desired by the user to have a spray zone in addition to that provided by the permanent spray system P. In this way, the auxiliary sprayers may be thought of as a removable spray module that can be placed anywhere within the treating chamber 24 as long as it can be directly or indirectly fluidly coupled to the auxiliary supply conduit 50. The module may be considered to include the auxiliary sprayer alone or in combination with any of the mounts, inlets, and couplers.

In operation, the user will select one or more of the auxiliary sprayers 60A, 60B and place them at the desired location in the treating chamber 24 and mount them to one of the utensil racks 26, 28 if warranted. The user will then connect the selected auxiliary sprayers 60A, 60B to the auxiliary supply conduit 50 by inserting the hose end into one of the fluid outlets 52. If a fluid coupler 70 is present, the user will connect the fluid coupler to the fluid outlet 52. The user will then select the desired cycle of operation from the user interface 49A on the controller 49 to initiate the cycle of operation. Alternatively, the controller 49 may select the appropriate cycle of operation.

Upon implementing the cycle of operation, the controller 49 will control the actuation of the pump assembly 32 and the diverter 54 to supply liquid to the primary spray system P and the auxiliary spray system A as needed to implement the selected cycle of operation. More specifically, the pump 32A draws liquid in from the sump 30 and delivers it to the selected primary or auxiliary spray system P, A as determined by the diverter 54. If the primary spray system P is selected, a primary liquid flow path fluidly is formed from the sump 30 to the permanent spray assemblies 34-40. If the auxiliary spray system A is selected, an auxiliary liquid flow path fluidly is formed from the sump 30 to the auxiliary spray assemblies 60A, 60B.

As the auxiliary sprayers 60A, 60B are removable from the dishwasher 10 and thus may not always present, it may be beneficial for the controller 49 to be capable of receiving an input regarding the presence of any such removable auxiliary sprayers 60A, 60B in the treating chamber 24. When the controller 49 is aware of the presence of an auxiliary sprayer, the controller 49 may control the diverter 54 to include the auxiliary sprayer in the implementation of the cycle of operation. The controller 49 may receive such an input from the user through the user interface 49A prior to starting a cycle of operation. Such a user input may include a specific button (direct indication) for indicating the presence of an auxiliary sprayer or it may include the user selecting a cycle of operation requiring an auxiliary sprayer (indirect indication).

Alternatively, during the cycle of operation, the controller 49 may determine whether a removable auxiliary sprayer is present in the treating chamber 24. The controller 49 may determine whether a removable auxiliary sprayer is fluidly coupled to the liquid recirculation system 48 in a number of ways. For example, a sensor 74 may be operably coupled to each of the fluid outlets 52 such that the sensors 74 may determine if the fluid inlet 61 of a removable auxiliary sprayer 60 has been inserted into the fluid outlet 52. Only one sensor 74 has been illustrated in FIG. 2 for the sake of clarity. The sensors 74 may provide output to the controller 49 indicative of a removable auxiliary sprayer being fluidly coupled to the auxiliary supply conduit 50.

The controller 49 may also determine the presence of a removable auxiliary sprayer 60A, 60B by supplying liquid to a predetermined location in the liquid recirculation system 48 and determining a characteristic of the supplied liquid. For example, the controller 49 may supply liquid to the auxiliary spray conduit 50 and then determine whether any of the supplied liquid is returned to the sump 30. If no auxiliary sprayer is present, then no liquid will flow out of the auxiliary spray conduit 50 and it will not be returned to the sump 30. The return of liquid to the sump 30 may be determined by monitoring the power consumed by the motor 32B or the speed of the motor 32B, without liquid being returned to the sump 30, the pump 32A may begin to be starved of liquid causing a decrease in the power consumed by the motor 32B and an increase in the speed of the motor 32B due to less load on the pump 32A. Other suitable sensors, such as liquid level sensors or optical sensors may be used.

If liquid is returned to the sump 30, the controller 49 may use the rate of return of the liquid to estimate the number of auxiliary sprayers 60A, 60B in the treating chamber 24. The greater the number of auxiliary sprayers 60A, 60B the greater will be the rate of return of the liquid to the sump 30. The rate of return may be determined in the same manner as determining the return of the liquid. The rate of return may then be compared to a table of reference values, with each reference value corresponding to a different number of auxiliary sprayers.

Alternatively, the controller 49 may use an operating characteristic of the pump assembly 32 to make the determination. When a removable auxiliary sprayer is fluidly coupled to the auxiliary spray conduit 50, the pump assembly 32 will try to compensate to maintain a desired flow rate. In this situation, operating characteristics of the pump assembly 32 including the electrical current drawn, speed, torque, and voltage for the motor 32B driving the pump assembly 32 may vary. Thus, by measuring parameters such as electric current drawn, speed, torque, voltage, and phase lag, the controller 49 may identify if a removable auxiliary sprayer 60 is fluidly coupled to the liquid recirculation system 48.

It has also been contemplated that the controller 49 may be able to determine the type of auxiliary sprayer that is fluidly coupled to the liquid recirculation system from the operating characteristics of the pump. In this manner, the pump assembly 32 becomes a sensor and the signals output by the pump assembly 32 may be monitored by the controller 49 and may be used to operate various components of the dishwasher 10 to implement a cleaning cycle of operation.

For example, the controller 49 may control the liquid diverter 54 to supply liquid to the auxiliary supply conduit 50 when it is determined that at least one removable auxiliary sprayer 60 is fluidly coupled to the auxiliary supply conduit 50. More specifically, once it has been sensed that a removable auxiliary sprayer 60 is fluidly coupled to the liquid recirculation system 48 the controller 49 may selectively recirculate liquid through the primary sprayers 34-40 and any removable auxiliary sprayers 60 in response to the sensing of the presence of the removable auxiliary sprayer 60. The controller 49 may employ the liquid diverter 54 to control the volume of the stream of liquid from the pump assembly 32 to each of the permanent spray assemblies 34-40 and to any removable auxiliary sprayers 60.

Figure 3:
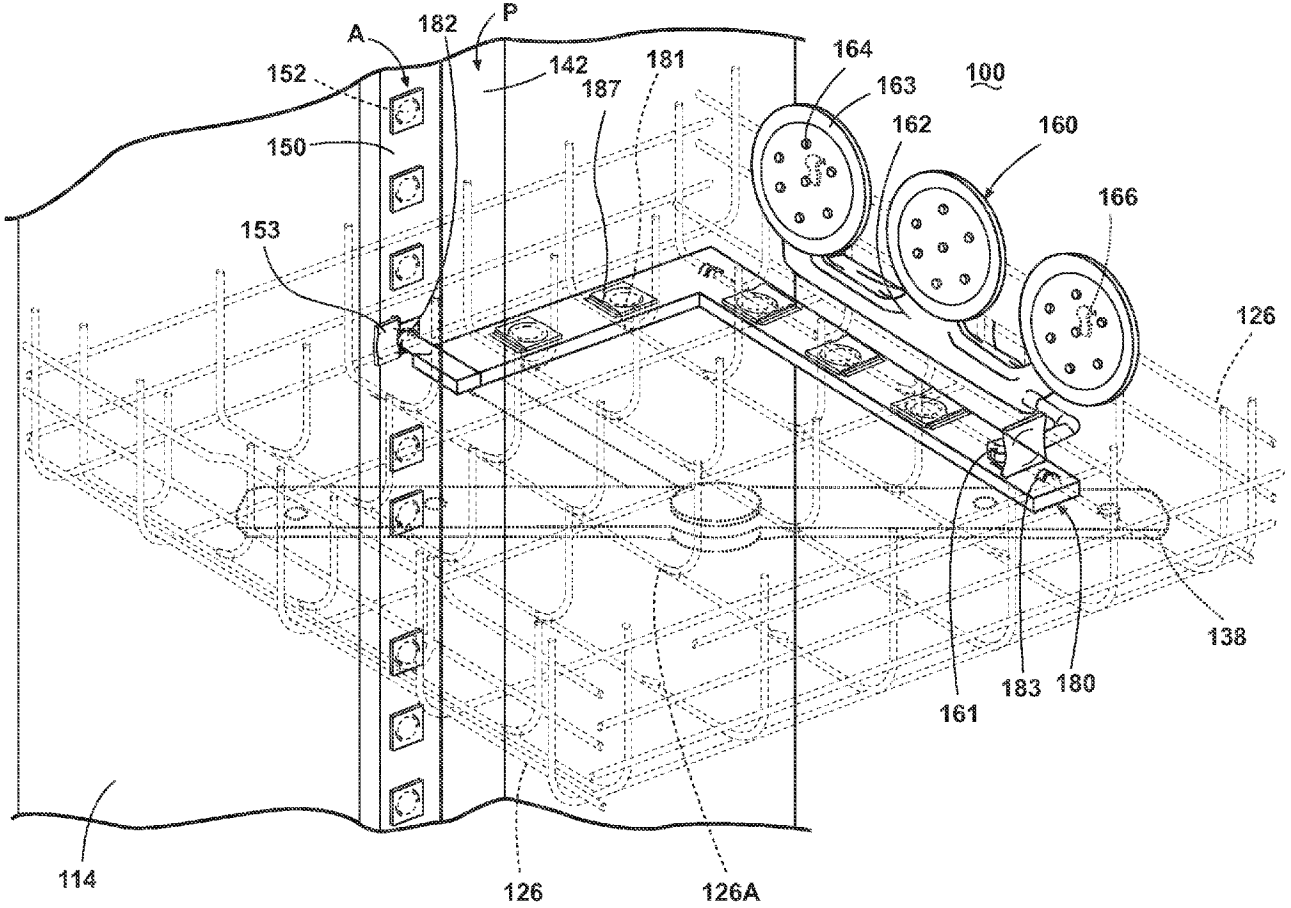
FIG. 3 is a perspective view of a portion of a dishwasher according to a second embodiment of the invention.

FIG. 3 illustrates a portion of a dishwasher 100 according to a second embodiment of the invention. The second embodiment 100 is similar to the first embodiment 10. Therefore, like parts will be identified with like numerals increased by 100, with it being understood that the description of the like parts of the first embodiment applies to the second embodiment, unless otherwise noted.

One difference between the first embodiment and the second embodiment is that the auxiliary spray system A has an auxiliary manifold 180 fluidly coupled to the auxiliary supply conduit 150. The auxiliary manifold 180 is illustrated as having a fluid inlet 182 which may be releasably coupled to at least one fluid outlet 152 of the auxiliary supply conduit 150. This fluid coupling may be made in much the same way that the removable auxiliary sprayer 60 could be coupled to the auxiliary supply conduit 50 in the first embodiment.

The auxiliary manifold 180 may have at least one manifold fluid outlet 181 provided on the auxiliary manifold 180. Multiple manifold fluid outlets 181 have been illustrated as being spaced apart along the along the length of the auxiliary manifold 180. Although multiple manifold fluid outlets 181 are shown in the present embodiment, fewer or more manifold fluid outlets could readily be provided. These manifold fluid outlets 181 may receive the fluid inlet 161 of a removable auxiliary sprayer 160. These manifold fluid outlets 181 may include a cover or valve 187, which may seal the manifold fluid outlets 181 when they are not coupled with a fluid inlet 161 of a removable auxiliary sprayer 160. Each valve may be moved between a closed position where it seals the manifold fluid outlet 181 and an open position where a fluid inlet 161 may be received within the manifold fluid outlet 181. Further, it has been contemplated that an alternative sealing mechanisms or valve may be used to fluidly seal each manifold fluid outlet 181 when it is not fluidly coupled with a removable auxiliary sprayer 160.

A user may releasably mount the auxiliary manifold 180 to either of the utensil racks or to the wash tub 114. The auxiliary manifold 180 is illustrated as being releasably mounted to the bottom 126A of the upper utensil rack 126 by manifold rack mounts 183. The auxiliary manifold 180 may move with the upper utensil rack 126 as it moves between the wash position and the load position. The auxiliary manifold 180 may be configured such that it fluidly uncouples from the auxiliary supply conduit 150 when the upper utensil rack 126 is moved from the wash position to the load position or it may be configured to remain coupled to the auxiliary supply conduit 150. In the case where it uncouples from the auxiliary supply conduit 150, it is further contemplated that the fluid inlet 182 may be configured to automatically fluidly couple to the auxiliary supply conduit 150 when the upper utensil rack 126 is moved from the load position to the wash position.

When the auxiliary manifold 180 is mounted to the bottom 126A of the upper utensil rack 126 it is located such that it is between a bottom 126A, bottom of the upper utensil rack 126 and the mid-level permanent spray assembly 138. The auxiliary manifold 180 is shaped such that it does not inhibit or hinder the movement of the mid-level permanent spray assembly 138. It is illustrated that when the auxiliary manifold 180 is mounted in such a position that at least one manifold fluid outlet 181 faces towards the upper utensil rack 126 such that a removable auxiliary sprayer 160 may be placed in and supported by the upper utensil rack 126 when coupled to at least one of the manifold fluid outlets 181.

Figure 4:
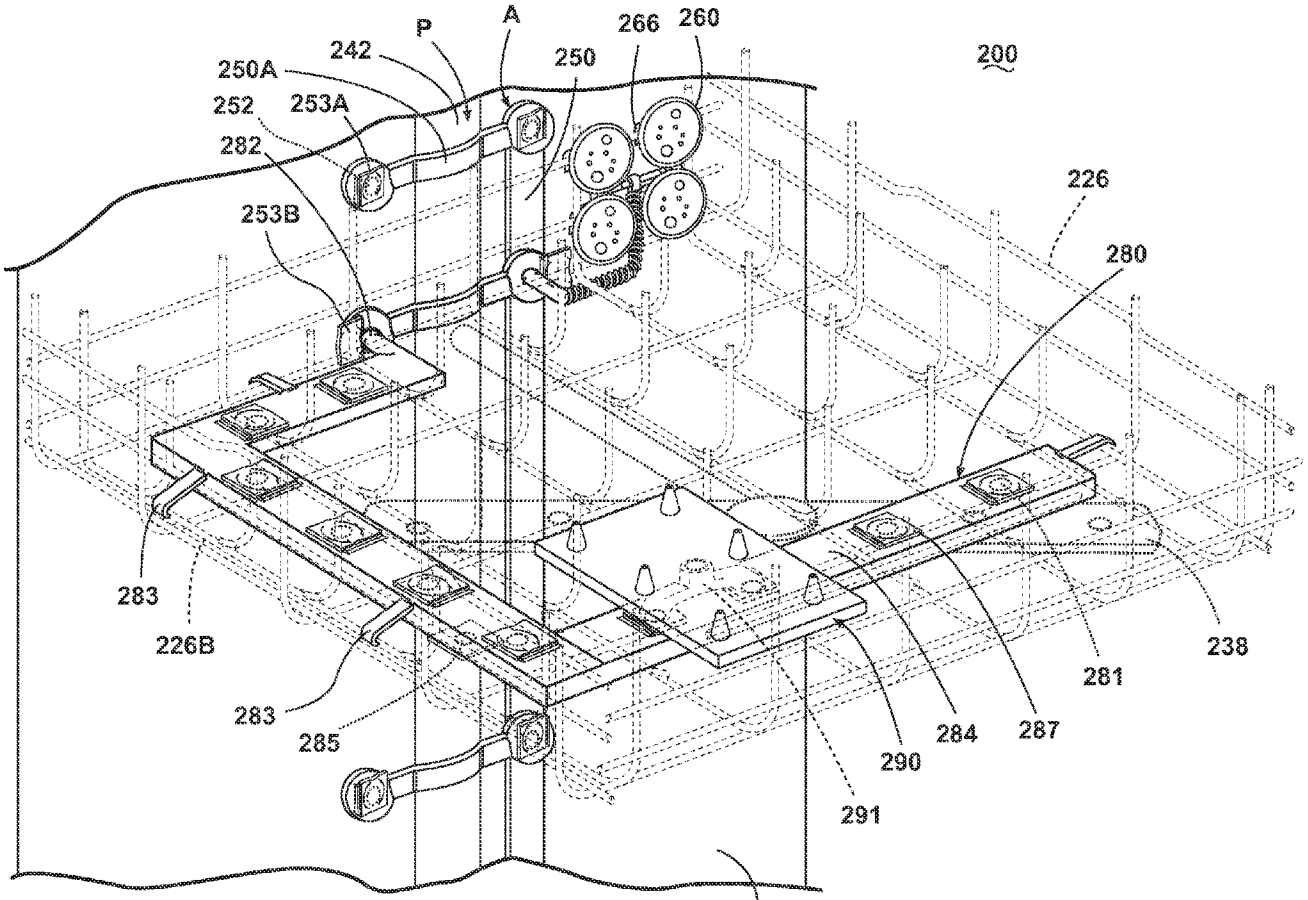
FIG. 4 is a perspective view of a portion of a dishwasher according to a third embodiment.

FIG. 4 illustrates a dishwasher 200 according to a third embodiment of the invention. The third embodiment 200 is similar to the second embodiment 100. Therefore, like parts will be identified with like numerals increased by 100, with it being understood that the description of the like parts of the first embodiment applies to the second embodiment, unless otherwise noted.

One difference between the second embodiment and the third embodiment is that the auxiliary spray system A includes an auxiliary supply conduit 250 having a secondary portion 250A. The secondary portion 250A may be fluidly coupled to the auxiliary supply conduit 250 and has been illustrated as being wrapped over the primary supply conduit 242 such that at least one fluid outlet 252 is located on either side of the primary supply conduit 242. This may allow for a user to mount removable auxiliary sprayers in additional locations inside the dishwasher 200. Another difference is that the auxiliary manifold 280 is illustrated as having an additional branch 284 and is illustrated as being mounted to a side wall 226B of the upper utensil rack 226 by manifold rack mounts 283.

Another difference is that the removable auxiliary sprayer 290 has an inlet fluid coupling 291 that releasably mates and fluidly couples with more than one of the manifold fluid outlets 281 of the auxiliary manifold 280. More specifically, it is illustrated that the inlet fluid coupling 291 is fluidly coupled with two of the manifold fluid outlets 281. The removable auxiliary sprayer 290 may be selectively releasably mounted to any two manifold fluid outlets 281 such that it may provide an auxiliary spray zone at several different locations within the treating chamber 224. It is also illustrated that multiple removable auxiliary sprayers 260, 290 may be simultaneously releasably mounted to the auxiliary supply conduit 250 and the auxiliary manifold 280, respectively, to provide multiple auxiliary spray zones in the treating chamber 224.

Figure 5:
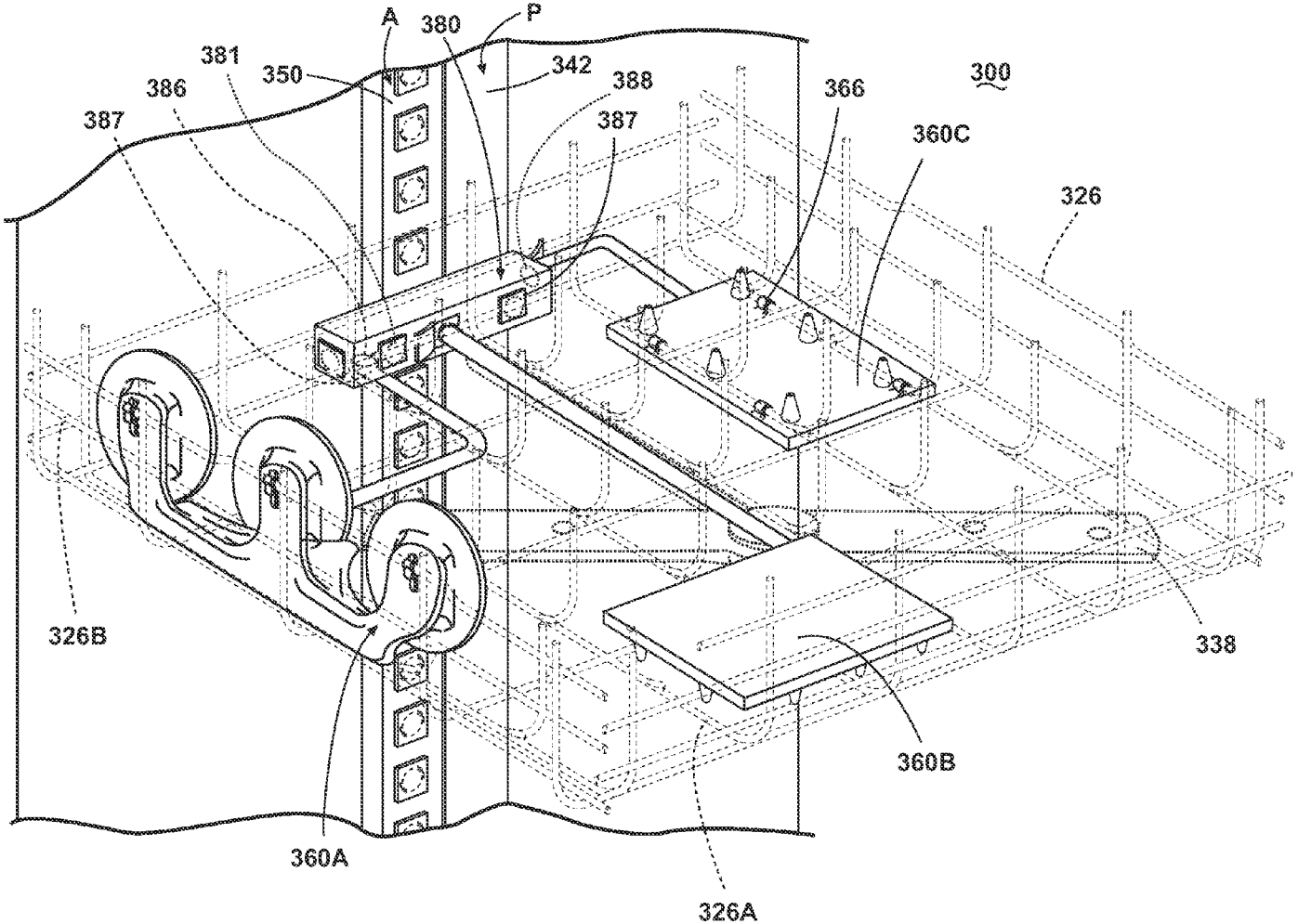
FIG. 5 is a perspective view of a portion of a dishwasher according to a fourth embodiment of the invention.

FIG. 5 illustrates a dishwasher 300 according to a fourth embodiment of the invention. The fourth embodiment 300 is similar to the second embodiment 100. Therefore, like parts will be identified with like numerals increased by 200, with it being understood that the description of the like parts of the first embodiment applies to the second embodiment, unless otherwise noted.

One difference between the fourth embodiment and the second embodiment is that the auxiliary spray system A includes an alternative auxiliary manifold 380. The auxiliary manifold 380 is illustrated as having multiple manifold fluid outlets 381 facing towards the upper utensil rack 326 such that a removable auxiliary sprayer 360B may be placed in and supported by the upper utensil rack 326 when it is coupled to the manifold fluid outlet 381. As illustrated, the auxiliary manifold 380 also has at least one downwardly facing manifold fluid outlet 386 and at least one manifold fluid outlet 388 facing a side wall 326B of the upper utensil rack 326. It has been illustrated that the removable auxiliary sprayer 360A is mounted to the side wall 326B of the upper utensil rack 326 and is fluidly coupled with the downwardly facing manifold fluid outlet 386. Removable auxiliary sprayer 360C is mounted to the bottom wall 326A of the upper utensil rack 326 and is fluidly coupled with the manifold fluid outlet 388 facing a side wall 226B of the upper utensil rack 326.

The several removable auxiliary sprayers thus far illustrated in FIGS. 1-5 have various shapes and sizes. These removable auxiliary sprayers provide non-limiting examples of the various removable auxiliary sprayers which may be used. It is contemplated that the removable auxiliary sprayers may take any of a variety of shapes and sizes, including shapes and sizes not illustrated herein. It has been contemplated that the auxiliary manifolds and auxiliary sprayers may take a variety of shapes and sizes and both may be mounted to various portions of the utensil racks or the wash tub. All of the description and operation of the auxiliary sprayers in FIGS. 1 and 2 may apply to the auxiliary sprayers in FIGS. 3-5. The removable auxiliary sprayers are generally intended to facilitate washing of difficult or irregularly-shaped utensils and may take various forms to facilitate in the washing of such utensils.

Typical dishwashers do not provide satisfactory control of washing based on load size, load location, and utensil type. Typical dishwashers normally spray wash liquid uniformly throughout the treating chamber and this may result in incomplete cleaning of more heavily soiled utensils. The apparatuses and method described above allow a user to introduce additional auxiliary spray zones into the treating chamber. This gives the user more control over how utensils in the dishwasher are washed. In this manner, the dishwasher may provide better washing performance as the dishwasher may increase both efficiency and the cleaning effectiveness of the wash process.

While the invention has been specifically described in connection with certain specific embodiments thereof, it is to be understood that this is by way of illustration and not of limitation, and the scope of the appended claims should be construed as broadly as the prior art will permit. For example, it has been contemplated that the invention may differ from the configuration shown in FIGS. 1-5, such as by inclusion of other conduits, utensil racks, valves, spray assemblies, seals, and the like, to control the flow of wash liquid.

What is claimed is:

1. A dishwasher comprising:

a tub at least partially defining a treating chamber;

at least one utensil rack provided in the treating chamber;

a liquid recirculation system comprising:

a primary supply conduit;

an auxiliary supply conduit having a fluid outlet; and a liquid diverter selectively diverting liquid between the primary supply conduit and the auxiliary supply conduit;

at least one permanent sprayer fluidly coupled to the primary supply conduit and located adjacent the utensil rack such that spray from the permanent sprayer is directed into the utensil rack to form a primary spray zone; and at least one selectively removable auxiliary sprayer forming an auxiliary spray zone and selectively releasably coupled to the fluid outlet of the auxiliary supply conduit;

wherein the auxiliary sprayer is moveably mounted within the treating chamber by coupling the auxiliary sprayer to any of a variety of portions of the utensil rack to provide an auxiliary spray zone at any of several different locations within the treating chamber and fluidly connecting the auxiliary sprayer to the fluid outlet of the auxiliary supply conduit to form an auxiliary spray zone within the treating chamber in addition to the primary spray zone and wherein the fluid outlet of the auxiliary supply conduit is fluidly sealed when it is not in use.

2. The dishwasher of claim 1, further comprising a fluid coupler fluidly connecting the fluid outlet of the auxiliary supply conduit to a fluid inlet of the auxiliary sprayer.

3. The dishwasher of claim 2 wherein the fluid coupler is a quick-connect coupling.

4. The dishwasher of claim 2 wherein the fluid coupler comprises a valve provided with one of the fluid inlet and fluid outlet, and a valve opener provided with the other of the fluid inlet and fluid outlet, such that the valve opener opens the valve when the auxiliary sprayer is fluidly coupled to the auxiliary supply conduit.

5. The dishwasher of claim 4 wherein the auxiliary sprayer comprises a mount for connecting the auxiliary sprayer to the utensil rack.

6. The dishwasher of claim 5 wherein the valve opener opens the valve when the auxiliary sprayer is connected to the utensil rack.

7. The dishwasher of claim 2 wherein the auxiliary supply conduit further comprises an auxiliary manifold fluidly coupled to the auxiliary supply conduit, with the at least one outlet provided on the auxiliary manifold.

8. The dishwasher of claim 7 wherein the auxiliary manifold mounts to at least one of the utensil rack and the tub.

9. The dishwasher of claim 8 wherein the auxiliary manifold releasably mounts to a bottom of the utensil rack and the at least one outlet faces toward the utensil rack such that the auxiliary sprayer may be placed in and supported by the rack when coupled to the at least one outlet.

10. The dishwasher of claim 9 wherein the utensil rack is slidably mounted for slidable movement relative to the tub between a wash position, where the utensil rack resides within the treating chamber, and a load position, where at least a portion of the utensil rack lies outside the treating chamber, and the auxiliary manifold fluidly uncouples from the auxiliary supply conduit when the utensil rack is moved from the wash position to the load position.

11. The dishwasher of claim 1 wherein the fluid outlet comprises multiple fluid outlets and the multiple fluid outlets are fluidly sealed when not in use.

12. The dishwasher of claim 11 wherein the auxiliary sprayer comprises an auxiliary spray module having a rack mount releasably mounting the auxiliary spray module to the utensil rack.

13. The dishwasher of claim 12 wherein the auxiliary spray module further comprises a fluid coupling releasably coupling the auxiliary spray module to at least one of the multiple outlets.

14. The dishwasher of claim 13 wherein the rack mount and fluid coupling are configured such that the fluid coupling couples to at least one of the multiple outlets when the auxiliary spray module is coupled to the utensil rack.

15. The dishwasher of claim 13, further comprising multiple spray modules that may be releasably mounted to at least one of the multiple outlets.

16. A dishwasher comprising:

a tub at least partially defining a treating chamber;

at least one utensil rack provided in the treating chamber;

at least one permanent sprayer located adjacent the at least one utensil rack to provide a primary spray zone into the utensil rack;

a liquid recirculation system comprising a liquid supply conduit supplying liquid to the at least one permanent sprayer;

an auxiliary manifold fluidly coupled to the liquid recirculation system and carried by the at least one utensil rack, with the auxiliary manifold having multiple fluid outlets; and at least one auxiliary sprayer having a fluid coupling releasably mating with at least one of the multiple fluid outlets, and forming an auxiliary spray zone;

wherein the auxiliary sprayer may be selectively releasably mounted with any of the multiple fluid outlets to provide an auxiliary spray zone at several different locations within the treating chamber.

17. The dishwasher of claim 16 wherein the auxiliary manifold comprises multiple branches.

18. The dishwasher of claim 16 wherein the auxiliary manifold is mounted to a wall of the utensil rack.

19. The dishwasher of claim 16 wherein the auxiliary manifold is mounted to a bottom wall of the utensil rack.

20. The dishwasher of claim 16, further comprising multiple auxiliary sprayers that may be releasably mounted to at least one of the multiple fluid outlets, whereby more than one of the multiple auxiliary sprayers may be simultaneously mounted to the auxiliary manifold to provide multiple auxiliary spray zones in the treating chamber.

21. The dishwasher of claim 20 wherein more than one of the multiple fluid outlets face toward the utensil rack such that the auxiliary sprayers may be placed in and supported by the rack when coupled to the at least one outlet.

22. The dishwasher of claim 21 wherein at least one of the fluid outlets face one of a bottom wall and a side wall of the utensil rack.

23. The dishwasher of claim 22 wherein at least one of the multiple auxiliary sprayers is mounted to the other of the bottom wall and side wall when fluidly coupled to the at least one of the fluid outlets.

24. The dishwasher of claim 16 wherein the liquid recirculation system further comprises an auxiliary supply conduit providing liquid to the auxiliary manifold.

25. The dishwasher of claim 21 wherein the liquid recirculation system comprises a liquid diverter selectively supplying liquid between the primary and auxiliary supply conduits.

26. A dishwasher comprising:

a tub at least partially defining a treating chamber;

at least one utensil rack provided in the treating chamber;

a liquid recirculation system comprising:

a primary supply conduit;

an auxiliary supply conduit; and a liquid diverter selectively diverting liquid from the tub to the primary supply conduit or the auxiliary supply conduit; and at least one permanent rotating spray arm fluidly coupled to the primary supply conduit and located adjacent the utensil rack such that spray from the rotating spray arm is directed into the utensil rack to form a primary wash zone;

at least one auxiliary spray module having an auxiliary sprayer selectively mountable in any of a variety of positions to provide an auxiliary spray zone at any of several different locations within the treating chamber, selectively fluidly coupled to the auxiliary supply conduit; and a controller operably coupled to the liquid diverter and controlling the liquid diverter to supply liquid to the auxiliary conduit when the at least one auxiliary spray module is fluidly coupled to the auxiliary supply conduit.

27. The dishwasher of claim 26, further comprising a sensor providing output indicative of the at least one auxiliary spray module being fluidly coupled to the auxiliary supply conduit.

28. The dishwasher of claim 27 wherein the sensor comprises a pump supplying liquid to the auxiliary supply conduit and the output comprises a characteristic of the pump.

29. The dishwasher of claim 28 wherein the pump comprises a motor and the characteristic of the pump is at least one of a motor current, motor voltage, motor speed, and motor torque.

30. The dishwasher of claim 26 wherein the auxiliary spray module comprises a housing that is removably mounted to the utensil rack.

31. The dishwasher of claim 26 wherein the auxiliary supply conduit further comprises an auxiliary manifold fluidly coupled to the auxiliary supply conduit and having at least one outlet to which the auxiliary spray module is fluidly coupled.

32. The dishwasher of claim 31 wherein the auxiliary manifold mounts to the utensil rack.

33. The dishwasher of claim 32 wherein the auxiliary manifold mounts to a bottom of the utensil rack and the at least one outlet faces toward the utensil rack such that the auxiliary spray module may be placed in the rack and coupled to the at least one outlet.

34. The dishwasher of claim 26 wherein the auxiliary supply conduit comprises a fluid outlet, the auxiliary spray module comprises a fluid inlet, and further comprising a fluid coupler fluidly connecting the fluid outlet to the fluid inlet.

35. The dishwasher of claim 34 wherein the fluid coupler comprises a valve provided with one of the fluid inlet and fluid outlet, and a valve opener provided with the other of the fluid inlet and fluid outlet, such that the valve opener opens the valve when the auxiliary spray module is fluidly coupled to the auxiliary supply conduit.

36. The dishwasher of claim 35 wherein the auxiliary spray module comprises a mount for connecting the auxiliary spray module to the utensil rack.

37. The dishwasher of claim 36 wherein the valve opener opens the valve when the auxiliary spray module is connected to the utensil rack.

* * * * *